US009664368B2

(12) United States Patent
Petroski

(10) Patent No.: US 9,664,368 B2
(45) Date of Patent: May 30, 2017

(54) THERMAL SOLUTION FOR LED BULBS

(75) Inventor: James T. Petroski, Parma, OH (US)

(73) Assignee: Advanced Energy Technologies LLC, Lakewood, OH (US)

( * ) Notice: Subject to any disclaimer, the term of this patent is extended or adjusted under 35 U.S.C. 154(b) by 786 days.

(21) Appl. No.: 13/979,166

(22) PCT Filed: Jan. 19, 2012

(86) PCT No.: PCT/US2012/021827

§ 371 (c)(1),
(2), (4) Date: Jul. 11, 2013

(87) PCT Pub. No.: WO2012/100022

PCT Pub. Date: Jul. 26, 2012

(65) Prior Publication Data

US 2013/0285529 A1 Oct. 31, 2013

Related U.S. Application Data

(60) Provisional application No. 61/434,395, filed on Jan. 19, 2011.

(51) Int. Cl.

| | |
|---|---|
| ***F21V 29/00*** | (2015.01) |
| ***F21V 29/70*** | (2015.01) |
| ***F21V 29/76*** | (2015.01) |
| ***F21V 29/77*** | (2015.01) |
| ***F21V 29/87*** | (2015.01) |
| ***F21K 9/23*** | (2016.01) |
| ***F21K 9/232*** | (2016.01) |
| *F21Y 115/10* | (2016.01) |

(52) U.S. Cl.

CPC ..... *F21V 29/22* (2013.01); *F21K 9/23* (2016.08); *F21K 9/232* (2016.08); *F21V 29/70* (2015.01); *F21V 29/763* (2015.01); *F21V 29/773* (2015.01); *F21V 29/87* (2015.01); *F21Y 2115/10* (2016.08)

(58) Field of Classification Search

CPC ..... F21V 29/22; F21V 29/773; F21V 29/87; F21V 29/70; F21V 29/763; F21K 9/135; F21K 9/13; F21Y 2101/02

USPC ..... 362/294

See application file for complete search history.

(56) References Cited

U.S. PATENT DOCUMENTS

| | | | | |
|---|---|---|---|---|
| 6,482,520 | B1 * | 11/2002 | Tzeng | H01L 21/4871 165/905 |
| 9,090,750 | B2 | 7/2015 | Rulkens et al. | |
| 2003/0183379 | A1 * | 10/2003 | Krassowski | F28F 3/048 165/185 |

(Continued)

FOREIGN PATENT DOCUMENTS

| | | | |
|---|---|---|---|
| EP | 0397152 | A1 | 11/1990 |
| EP | 2206951 | A1 | 7/2010 |

OTHER PUBLICATIONS

International Search Report and Written Opinion of the International Searching Authority issued for PCT/US12/021827 on Sep. 5, 2012.

*Primary Examiner* — Donald Raleigh

(57) ABSTRACT

A light bulb (10) including an outer housing (12) shaped like a standard Edison light bulb. The interior of the bulb includes a circuit board (24) and one or more LEDs (26). A heat sink (30) is provided inside the bulb housing that draws thermal energy away from the LEDs using graphite based materials.

5 Claims, 6 Drawing Sheets

(56) References Cited

U.S. PATENT DOCUMENTS

| | | | | |
|---|---|---|---|---|
| 2004/0174651 | A1* | 9/2004 | Aisenbrey | F21V 29/89 361/103 |
| 2008/0253125 | A1 | 10/2008 | Kang | |
| 2009/0002995 | A1 | 1/2009 | Lee | |
| 2010/0259935 | A1* | 10/2010 | Scordino | F21K 9/00 362/294 |
| 2010/0277067 | A1* | 11/2010 | Maxik | F21V 3/00 315/32 |
| 2011/0259570 | A1* | 10/2011 | Suzuki | H01L 21/4882 165/185 |
| 2012/0080699 | A1* | 4/2012 | Chowdhury | F21V 7/22 257/98 |
| 2016/0029481 | A1* | 1/2016 | Augoustidis | F21V 29/83 313/35 |

* cited by examiner

THERMAL SOLUTION FOR LED BULBS

TECHNICAL FIELD

With the threat of global warming, carbon trading schemes and exhaustion of natural resources, greater emphasis is being placed on energy efficiency. One particular area of focus has been in lighting, where the incandescent bulb has been in use for over 100 years. As its longevity suggests, the incandescent bulb is a highly robust and universally accepted design. However, efficiency and lifespan now render the incandescent bulb obsolete. In particular, for example, for the same amount of lumens produced, an LED uses approximately one tenth of the power. However, given the universal acceptance of the incandescent bulb, millions of home and business owners have lights that are designed to accept an incandescent bulb. The costs associated with replacing all these light sources with others, such as lighting solutions specifically designed for LEDs, would be prohibitively expensive.

There is therefore a need in the art for a higher efficiency bulb that fits within preexisting sockets designed for incandescent bulbs.

BACKGROUND ART

According to one aspect of the present invention a light bulb includes an outer housing with a bulbous upper portion and a tapered lower portion. The bulbous upper portion may be translucent and the tapered lower portion includes one or more apertures. A circuit board has a top surface and a bottom surface and includes one or more LEDs positioned on the top surface. A heat sink is positioned inside the tapered lower portion and proximate to the bottom surface of the circuit board. The heat sink includes a core and a plurality of fins extending outwardly from the core.

According to another aspect of the present invention, a light bulb includes an outer housing with a bulbous upper portion and a tapered lower portion having an interior surface. The bulbous upper portion is translucent. A circuit board has a top surface, a bottom surface, and a circumferential edge and includes one or more LEDs positioned on the top surface. A thermal management assembly includes a planar portion extending along at least a portion of the bottom surface of the circuit board between at least one of the LEDs and the circumferential edge. An interior surface engaging portion extends to the circumferential edge and along at least a portion of the interior surface of the tapered lower portion.

BEST MODE FOR CARRYING OUT THE INVENTION

Figure 1:
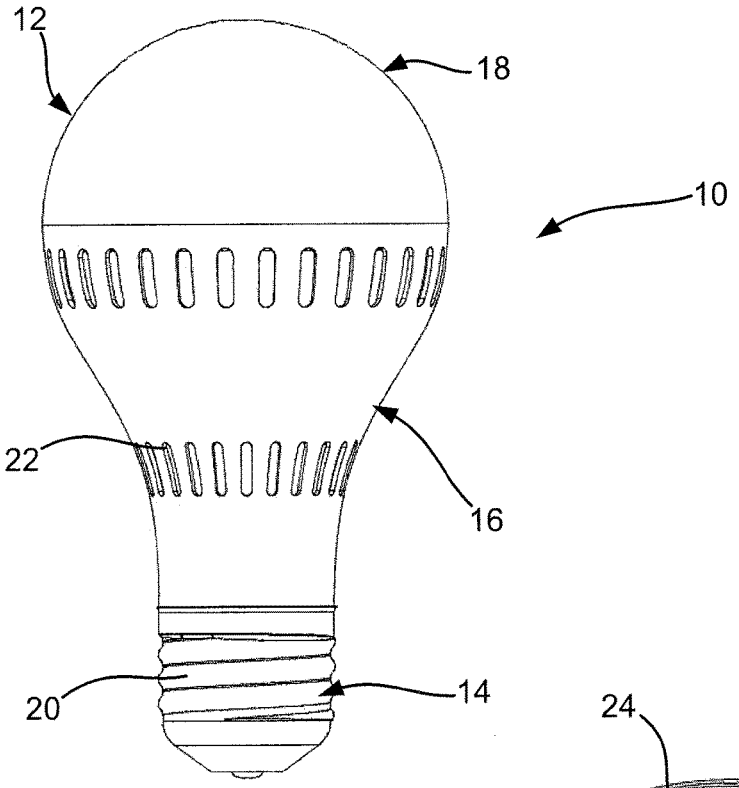
FIG. 1 is a side view of an LED bulb according to an embodiment disclosed herein.

With reference now to FIG. 1, an LED bulb is shown and generally indicated by the numeral 10. Bulb 10 has an outer housing 12 including a base 14, lower section 16 and upper section 18. As can be seen in FIG. 1, housing 12 is of the same general shape as a traditional incandescent light bulb. Thus, in particular, base 14 includes threads 20 and is of a diameter so that it may be installed in a standard lighting socket. For example, but in no way limiting, base may be sized to fit a standard Edison medium socket (E27).

Lower section 16 is generally tapered and includes a plurality of slots 22. Slots 22 may be provided in one or more circumferential rows. Alternately, slots 22 may be provided in an evenly dispersed pattern around lower section 16. Still further, slots 22 may be randomly dispersed. Slots 22 may be sized to allow outside air to communicate with the interior volume of housing 12. Lower section 16 may be clear, opaque or partially translucent. Lower section 16 may be any color, but is preferably white. Upper section 18 is bulbous shaped and is secured to lower section 16 at the circumferential periphery to complete the oblong bulb shape of housing 12. Upper section 18 is adapted to allow light transmission therethrough. Accordingly, upper section 18 may be transparent or translucent.

Figure 2:
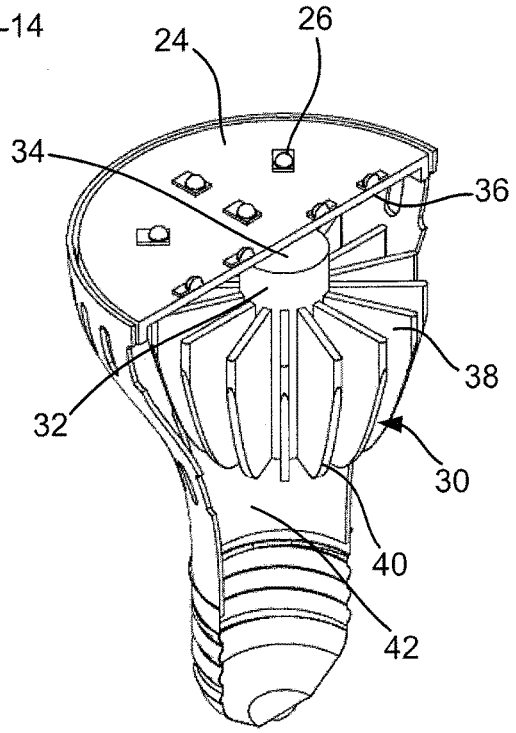
FIG. 2 is a partially sectioned isometric view of the LED bulb shown in FIG. 1.
Figure 3:
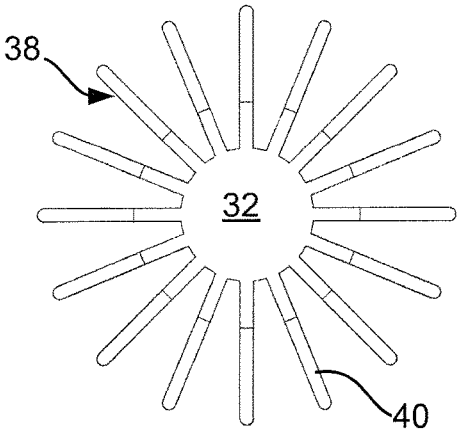
FIG. 3 is a bottom view of an insert.
Figure 4:
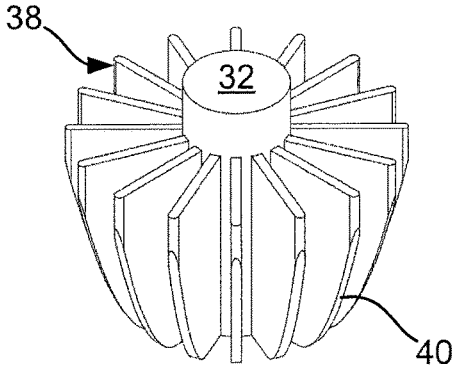
FIG. 4 is an isometric view of the insert of FIG. 3.
Figure 5:
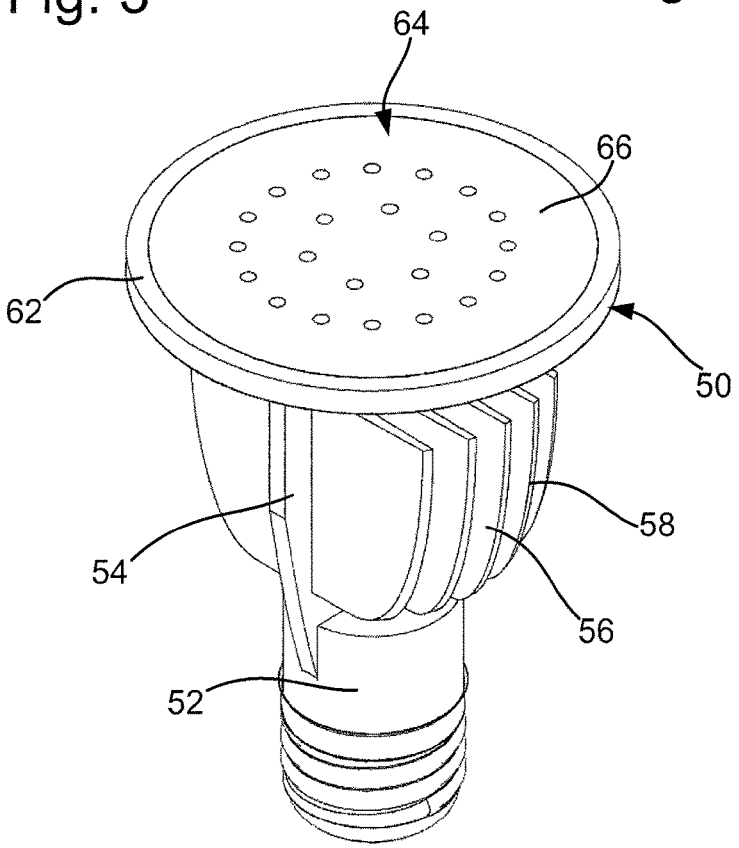
FIG. 5 is an isometric view of an LED bulb with the outer cover and PCB removed for clarity.
Figure 6:
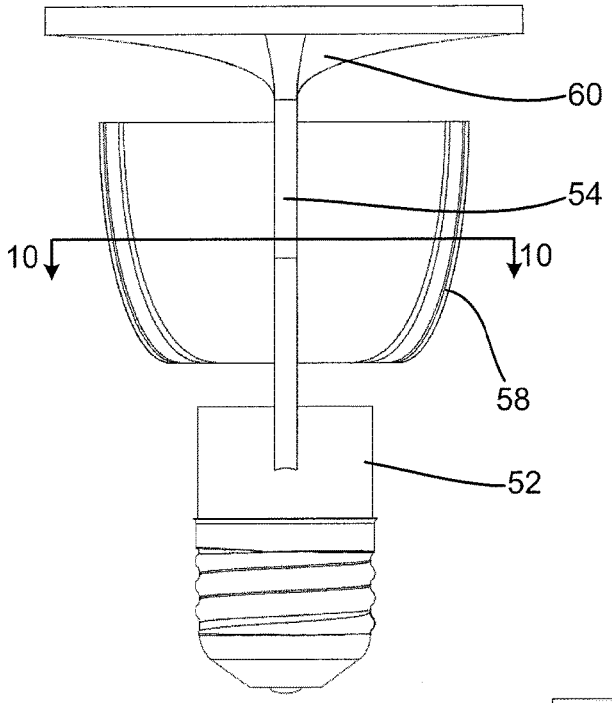
FIG. 6 is a side view of the LED bulb shown in FIG. 5.
Figure 7:
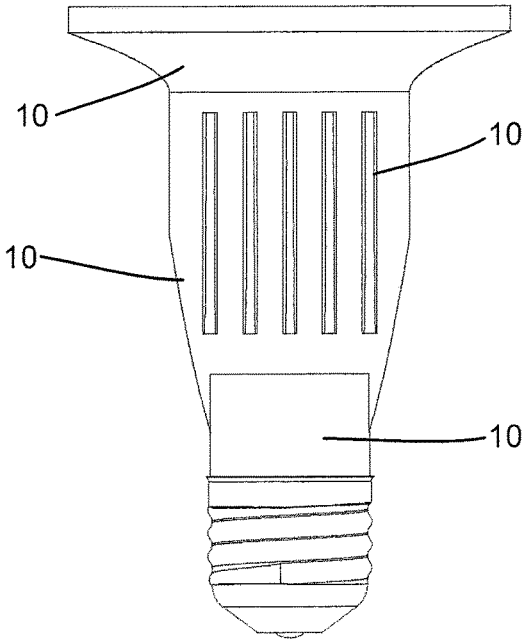
FIG. 7 is a front view of the LED bulb shown in FIG. 5.
Figure 8:
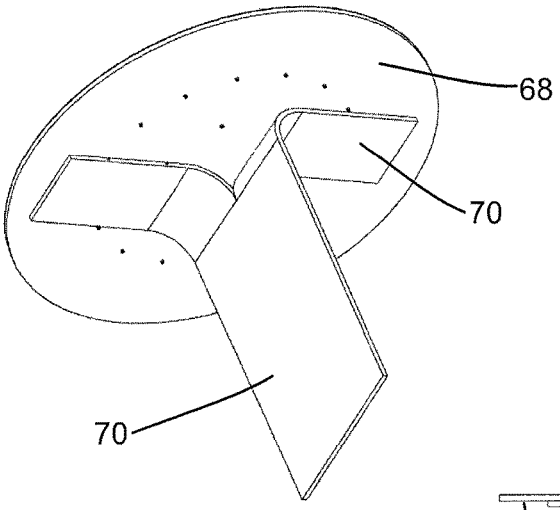
FIG. 8 is an isometric view of a heat transfer element.
Figure 9:
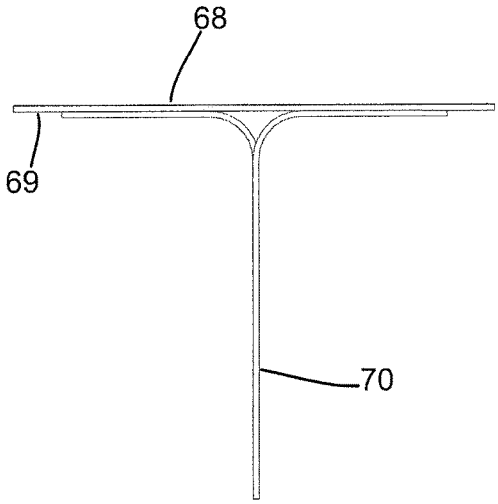
FIG. 9 is a side view of the heat transfer element shown in FIG. 8.
Figure 10:
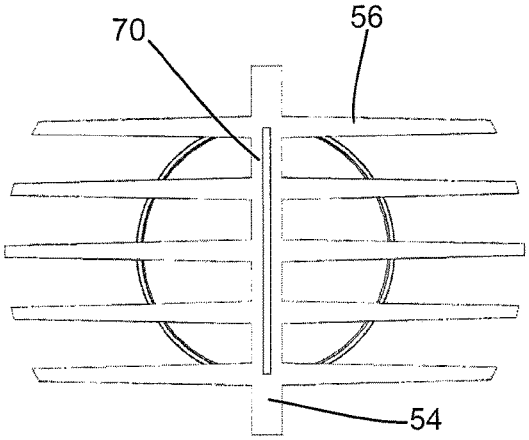
FIG. 10 is a section view taken along line 10-10 of FIG. 6.

With reference now to FIG. 2-4, a generally disc shaped circuit board 24 is positioned proximate to the intersection of upper section 18 and lower section 16. Circuit board 24 has one or more LEDs 26 mounted thereon. Circuit board 24 may further include power electronics for receiving electronic power and conditioning it for use by the one or more LEDs. Electricity is routed from the base 14 to the circuit board 24 by one or more wires (not shown). The power electronics and LEDs each create heat during use. This heat, if not properly dissipated could damage or reduce the life of the power electronics or LEDs.

In light of the aforementioned heat generation issues, a heat sink 30 is provided in the interior volume of the lower section 16. Heat sink 30 includes a central core 32 that is generally cylindrical and includes a top face 34 that contacts a portion of the bottom face 36 of circuit board 24. Heat sink 30 may be secured to circuit board 24 by adhesive or mechanical means. A thermal interface material may be provided between the circuit board 24 and heat sink 30 to improve thermal conductivity therebetween.

Extending outwardly from the central core 32 are a plurality of circumferentially spaced fins 38. In one embodiment, fins 38 are flat, as shown in FIGS. 2-4, and include an outer edge 40 having a profile that matches the profile of the opposing inner face 42 of the lower section 16. In one embodiment, the outer edge 40 extends to and contacts the inner face 42 of the lower section 16. In other embodiments, the outer edge 40 is spaced from the inner face 42 of lower section 16.

Heat sink 30 may be made of any thermally conductive material. In one embodiment, heat sink 30 is made of a plastic material having a thermally conductive additive therein, such as, for example, graphite powder or flake. In this manner the heat sink 30 is light weight and may be injection molded for low cost manufacture. In one embodiment, the plastic material with thermally conductive additive has an isotropic thermal conductivity of at least about 10 W/m-K. In other embodiments, the isotropic thermal conductivity is at least about 20 W/m-K. In still other embodiments, the heat isotropic thermal conductivity is between 10 and 20 W/m-K.

In other embodiment's the core 32 and/or fins may be made of a graphite based material which may be, for example, graphite sheet, extruded graphite, and/or thermally conductive graphite foam materials. The graphite sheet may be compressed expanded natural graphite, resin impregnated compressed expanded natural graphite, graphitized polyimide sheet or combinations thereof. The graphite sheet may optionally be coated with a thin film of dielectric material on one or both sides to provide electrical insulation. In one or more embodiments, the graphite sheet exhibits an in-plane thermal conductivity of at least 150 W/m*K. In still other embodiments, the graphite sheet exhibits an in-plane thermal conductivity of at least 300 W/m*K. In still other embodiments the graphite sheet exhibits an in-plane thermal conductivity of at least 700 W/m*K. In still other embodiments, the graphite sheet exhibits an in-plane thermal conductivity of at least 1500 W/m*K. In one embodiment, the graphite sheet material may be from 10 to 1500 microns thick. In other embodiments the graphite material may be from 20 to 40 microns thick. Suitable graphite sheets and sheet making processes are disclosed in, for example, U.S. Pat. Nos. 5,091,025 and 3,404,061, the contents of which are incorporated herein by reference.

With reference now to FIGS. 5-10 an alternate embodiment of the bulb 10 is shown with the upper section 18 and lower section 16 removed to better show the interior components. A heat sink 50 provides both structural support and an integral heat sink. Heat sink 50 includes a generally cylindrical base 52 that engages base 12. Cylindrical base 52 may be solid or hollow to reduce the overall weight. A core 54 extends upwardly from cylindrical base 52. Core 54 may be generally planar and/or rectangular with a plurality of fins 56 extending perpendicularly from opposed sides thereof. Fins 56 may be evenly spaced and have a curved outer edge 58.

Heat sink 50 may be made of a thermally conductive material. In one embodiment, heat sink 50 is made of a plastic material having a thermally conductive additive therein, such as, for example, graphite powder or flake. In one embodiment, only the core 54 and fins 56 are thermally conductive. In one embodiment, the heat sink 50 has a thermal conductivity of at least 10 W/m-K. In other embodiments, the thermal conductivity is at least 20 W/m-K. In still other embodiments, the heat sink 50 has a thermal conductivity of between 10 and 20 W/m-K.

A pedestal portion 60 extends upwardly and outwardly from core 54. Pedestal 60 forms a circular base with an upwardly extending flange 62 that provides a mounting area for a thermal management assembly 64. Thermal management assembly 64 includes a top disc 66 that may be mechanically (by lancing for example) or adhesively attached to a bottom disk 68. Top disk 66 may be made of any material capable of transferring thermal energy, for example a metal such as copper or aluminum. The bottom disk 68 may be made of a graphite based material as disclosed above. It should be appreciated, however, that top disk 66 is optional and heat sink assembly 64 may include only a bottom disk 68.

Thermal management assembly 64 further includes one or more legs 70 that contiguously extend along a portion of the bottom surface 69 of the bottom disk 68 and then perpendicularly down into core 54. In one embodiment, the leg 70 extends into core 54 to a point proximate to the bottom of fin 56. In this or other embodiments the leg 70 may be spit at the top and extend at 180 degrees relative to each other along the bottom disk 68.

A PCB (not shown) with one or more LEDs and optionally power electronics are secured at the top surface of thermal management assembly 66. In this manner, heat generated by the LEDs is transferred to the bottom disk 68, optionally through a top disk 66, and down leg 70 into core 54. In other embodiments, no top or bottom disk 66 and 68 are provided, and legs 70 extend along and directly contact the bottom surface of the PCB. Thereafter, heat may be transferred to ambient air within the interior volume of bulb 10 via fins 56.

Figure 11:
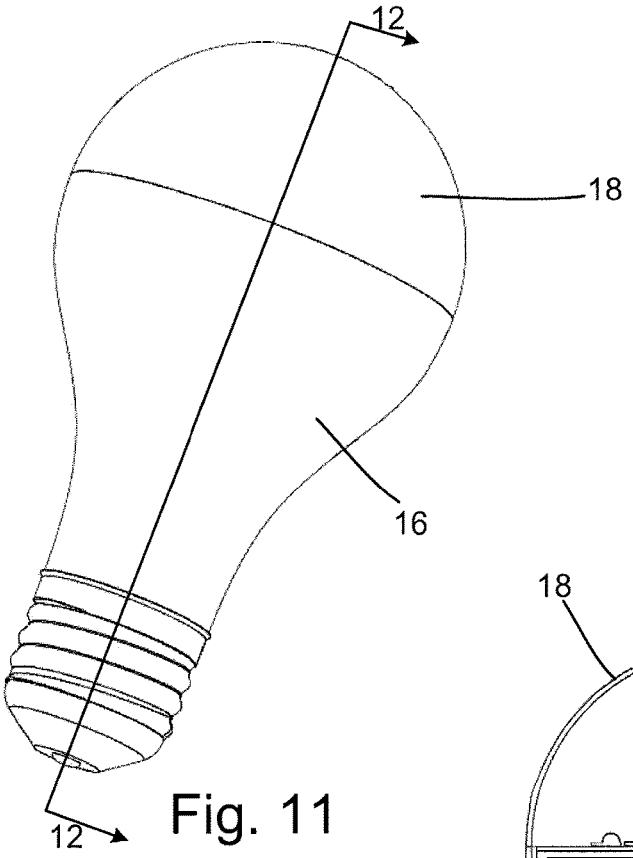
FIG. 11 is an isometric view of an LED bulb having no outer vents.
Figure 12:
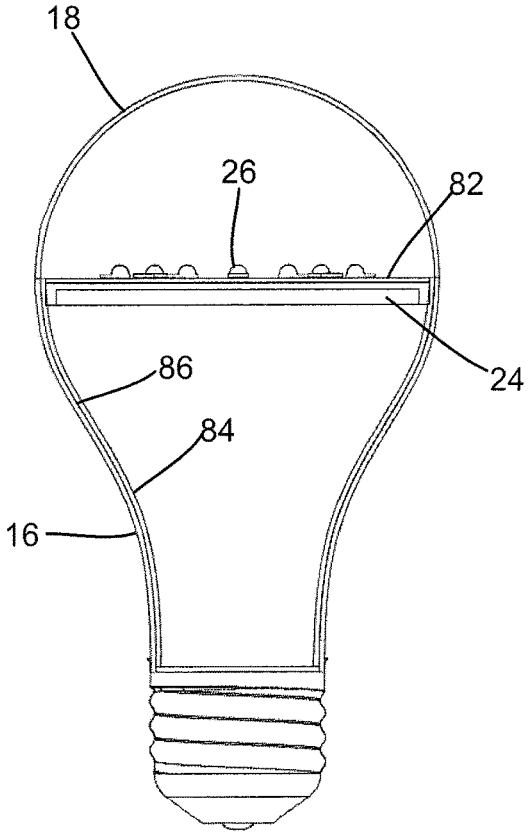
FIG. 12 is a section view taken along line 12-12 of FIG. 11.

With reference now to FIGS. 11 and 12, where like numerals indicate like elements, an alternate embodiment of the bulb 10 is shown. With particular reference to FIG. 12, lower section 16 may or may not include slots 22 and circuit board 24 is positioned proximate to the intersection of upper section 18 and lower section 16. Circuit board 24 is generally disc shaped and has one or more LEDs 26 mounted thereon. Circuit board 24 may further include power electronics for receiving electronic power and conditioning it for use by the one or more LEDs. Electricity is routed from the base 14 to the circuit board 24 by one or more wires (not shown).

A thermal management assembly 80 is provided on the interior of the housing and transfers heat from the LEDs to the exterior of the housing. Assembly 80 includes planar portion 82 positioned on the top surface of the circuit board 24 and positioned proximate to at least one LED 26. In one or more embodiments, planar portion 82 is disk shaped with cutouts for LEDs 26 and any other component on the circuit board 24. In other embodiments, the planar portion 82 includes one or more strips that extend from locations proximate to one or more LEDs to locations proximate to the edge of circuit board 24. In still other embodiments planar portion 82 is positioned at the bottom of circuit board 24. In any event, planar portion extends from location(s) proximate to one or more LEDs 26 to locations proximate to and contacting the peripheral edge of circuit board 24 where it engages an interior surface engaging portion 84 of the assembly 80. Interior surface engaging portion 84 contacts the interior surface 86 of bottom portion 18 of housing 12. In one embodiment, the interior surface engaging portion 84 extends substantially the entire longitudinal length of the bottom portion 18. In this or other embodiments, the interior engaging portion 84 extends along substantially the entire interior circumference of bottom portion 18. In these or other embodiments, planar portion 82 and/or interior engaging portion 84 may be a single contiguous piece of material.

The planar portion 82 may be made of any material capable of transmitting thermal energy. For example, planar portion 82 may be a metal such as aluminum or copper. In a particularly preferred embodiment, planar portion 82 is a graphite based material as disclosed above. Interior surface engaging portion 84 is a graphite based material as disclosed above. In this manner, thermal energy is transferred from the LEDs and optionally from power electronic components to the base portion 18 where it may be transferred out of bulb 10 through contact with the outside surface of bottom portion 18 with ambient air.

Figure 13:
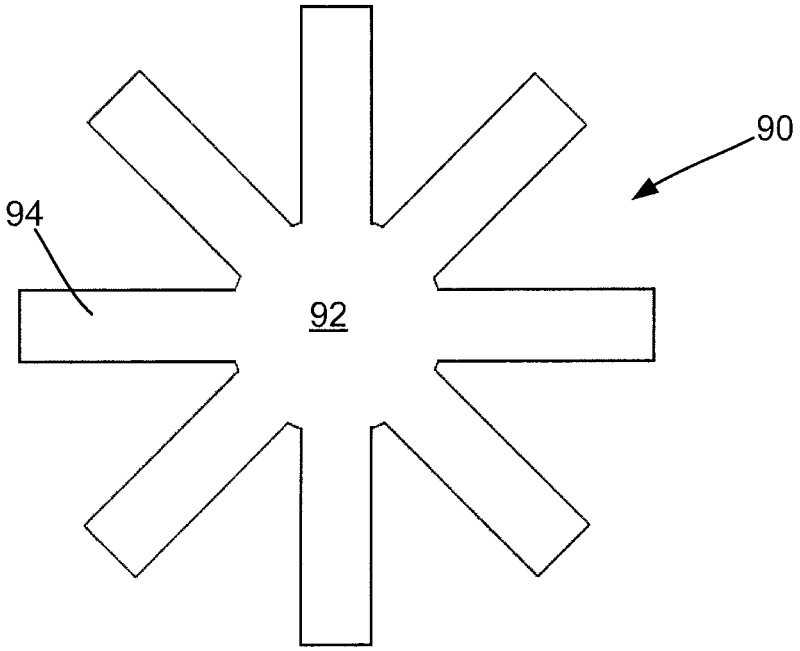
FIG. 13 is a top view of a thermal management assembly.

With reference to FIG. 13, an alternate assembly 90 is shown wherein assembly 90 is made of a single integral piece. Assembly 90 includes a planar portion 92 and legs 94 made from a contiguous element. Assembly 90 may be die cut, for example, and be made of a graphite material as described above. Assembly 90 may be a laminate material, wherein a first layer is a graphite material and a second layer is a resilient material, such as a metal, for example aluminum. Assembly 90 may be positioned such that the planar portion 92 is positioned on the top surface of circuit board 24, with portions cut out to receive the LEDs and/or power electronics. Accordingly, planar portion 90 may be generally disk shaped and of the same diameter as circuit board 24. In one embodiment, planar portion 92 may be positioned and secured against the bottom surface of circuit board 24. If assembly 90 is a laminated material, advantageously the graphite material layer is in direct contact with the source of heat. In other words, the graphite material layer is engaged with the circuit board.

When assembled, or prior thereto in a preliminary operation, legs 94 are bent downward to fit within the interior space of the base portion 18. Legs 94 may engage the interior surface of base portion 18. In such an embodiment, legs 94 may be maintained against the interior surface of base portion 18 by means of the resilient force of the assembly. In other words, the legs 94 may be bent and the resilient spring force of the assembly 90 may hold legs 94 against the interior surface of base portion 18. In this or other embodiments, the legs 94 may be secured to the interior surface of base portion with an adhesive. In still other embodiments, the legs 94 may be bent so that they extend freely into base portion 18 and do not contact the walls of the housing. In this embodiment, advantageously, base portion 18 includes one or more apertures to allow ambient air to communicate with the interior volume of base portion 18.

The various embodiments described herein can be practiced in any combination thereof. The above description is intended to enable the person skilled in the art to practice the invention. It is not intended to detail all of the possible variations and modifications that will become apparent to the skilled worker upon reading the description. It is intended, however, that all such modifications and variations be included within the scope of the invention that is defined by the following claims. The claims are intended to cover the indicated elements and steps in any arrangement or sequence that is effective to meet the objectives intended for the invention, unless the context specifically indicates the contrary.

What is claimed is:

1. A light bulb comprising:

an outer housing with a bulbous upper portion and a tapered lower portion having an interior surface, said bulbous upper portion being translucent:

a circuit board having a top surface, a bottom surface, and a circumferential edge and including one or more LEDs positioned on said top surface; and a thermal management assembly including a planar portion extending along at least a portion of said circuit board between at least one said LED and said circumferential edge, and an interior surface engaging portion extending to said circumferential edge and in contact with substantially the entire longitudinal length of said interior surface of said tapered lower portion.

2. The light bulb of claim 1 wherein at least one of said planar portion and said interior surface engaging portion comprises a compressed mass of exfoliated graphite particles.

3. The light bulb of claim 1 wherein at least one of said planar portion and said interior surface engaging portion comprises a graphitized polyimide sheet.

4. The light bulb of claim 1 wherein said interior surface engaging portion extends in contact with substantially the entire interior circumference of said tapered lower portion.

5. The light bulb of claim 4 wherein said interior surface engaging portion is a single contiguous piece.

* * * * *